United States Patent [19]

Tong

[11] Patent Number: 4,832,650

[45] Date of Patent: May 23, 1989

[54] AQUATIC TOYS

[75] Inventor: Duncan Tong, Hong Kong, Hong Kong

[73] Assignee: Duncan Products Limited, Hong Kong

[21] Appl. No.: 157,431

[22] Filed: Feb. 18, 1988

Related U.S. Application Data

[63] Continuation-in-part of Ser. No. 72,089, Jul. 9, 1987, abandoned.

[30] Foreign Application Priority Data

Nov. 10, 1986 [GB] United Kingdom ..... 8626817
Nov. 9, 1987 [GB] United Kingdom ..... 8726213

[51] Int. Cl.[4] ..... A63H 23/10; A63H 23/14

[52] U.S. Cl. ..... 446/156; 43/26.2; 446/158

[58] Field of Search ..... 446/158, 156, 157, 153, 446/154, 161, 162, 163, 164, 578, 368; 43/26.1, 26.2, 42

[56] References Cited

U.S. PATENT DOCUMENTS

| | | | |
|---|---|---|---|
| 1,928.418 | 9/1933 | Garland | 446/168 |
| 3,601,922 | 8/1971 | Shaffer | 446/156 |
| 3,808,734 | 5/1974 | Suzuki | 446/158 |

FOREIGN PATENT DOCUMENTS

| | | | |
|---|---|---|---|
| 626886 | 7/1949 | United Kingdom | 446/168 |
| 1315695 | 5/1973 | United Kingdom | 43/26.2 |
| 1390224 | 4/1975 | United Kingdom | 446/168 |

*Primary Examiner*—Mickey Yu
*Attorney, Agent, or Firm*—Townsend and Townsend

[57] ABSTRACT

Self-propelled aquatic toys lide toy sharks are known having a body portion, a middle tail and an outer tail. The middle tail has been driven to oscillate from side to side while outer tail has flapped freely from side to side. Better propulsion and simulation is, however, achieved by driving the outer tail. In this way, operation of the drive at either limit of oscillation initially drives the outer tail to the same sense, i.e. left or right, as the middle tail and thereafter the middle tail and together with the outer tail is moved from that limit position towards the other limit position.

7 Claims, 4 Drawing Sheets

AQUATIC TOYS

CROSS REFERENCE TO RELATED APPLICATION

This application is a Continuation-in-part of my copending Patent Application Ser. No. 07/072 089 filed on the July 9th 1987, abandoned.

This invention relates to self-propelled aquatic toys whose movement gives a high degree of realism to the action of a real life sea creature.

BACKGROUND TO THE INVENTION

United Kingdom Patent Specification No. 1 390 244 decribes one form of self-propelled aquatic toy. The toy has a body portion and at the rear a middle tail and an outer tail. The middle tail is pivoted by suitable drive means so that it reciprocates from side to side and the outer tail is freely pivoted to the middle tail. As a result, such a toy is driven through the water by the side-to-side reciprocation of the middle tail and some power in driving the creature is obtained as the outer tail flaps from side to side.

We have however found that such a toy is not very effective and efficient in being driven forward through the water and it is therefore an object to the present invention to improve the driving action of such aquatic toys.

United Kingdom Patent Specification No. 626,886 shows a fish with several sections which pivot relative one another. However, each section is not individually driven.

BRIEF SUMMARY OF THE INVENTION

According to the invention, there is provided a self-propelled aquatic toy comprising a body portion, a middle tail pivotably mounted relative the body and an outer tail pivotably mounted relative the middle tail, drive means being provided in the body portion to reciprocate the middle tail portion from side to side about an upright axis when the toy is being driven through the water, those drive means additionally being pivotally connected to the outer tail portion, a degree of backlash being provided in the driving of the middle tail, whereby operation of the drive means at either limit of reciprocation of the middle tail initially takes up the backlash to drive the outer tail to pivot in the same sense, i.e. left or right, relative the middle tail and the middle tail is then positioned relative the body and thereafter the middle tail moves from that limit position to the other limit position.

We found that by driving the outer tail in addition to the middle tail in this manner, a substantial improvement in the propulsion effect is achieved. Thus, before any movement of the middle tail, the outer tail is initially moved to the same extreme as the middle tail so giving the sea creature an overall curved effect as seen from above and thereafter, when the middle tail is then moved from that limit position towards the other extreme limit position, a substantial driving or sculling force is provided by the outer tail. In this way, the driving operation is a good simulation of the way in which real sea creatures having this type of swimming action operate. Good examples of such creatures are sharks who have this side to side swimming action when seen from above as opposed to an up and down action as seen from the side which is for example adopted by a whale. The invention therefore is particularly applicable to the simulation of toy sharks and related sea creatures.

In a toy according to the invention, the driving mechanism can be very simple. Thus, some forms of crank means are provided to oscillate the middle tail back and forth. Also, by providing the degree of backlash as explained above between those drive means and the middle tail, no separate crank means or the like for driving the outer tail are required. Instead the outer tail can be driven as a result of the backlash between the crank means driving the middle tail and the middle tail portion. This is obviously an important advantage in keeping the overall construction of the toy according to the invention simple.

BRIEF DESCRIPTION OF THE DRAWINGS

A toy shark according to the invention will now be described, by way of example, with reference to the accompanying drawings, in which.

DESCRIPTION OF THE PREFERRED EMBODIMENT

Figure 1:
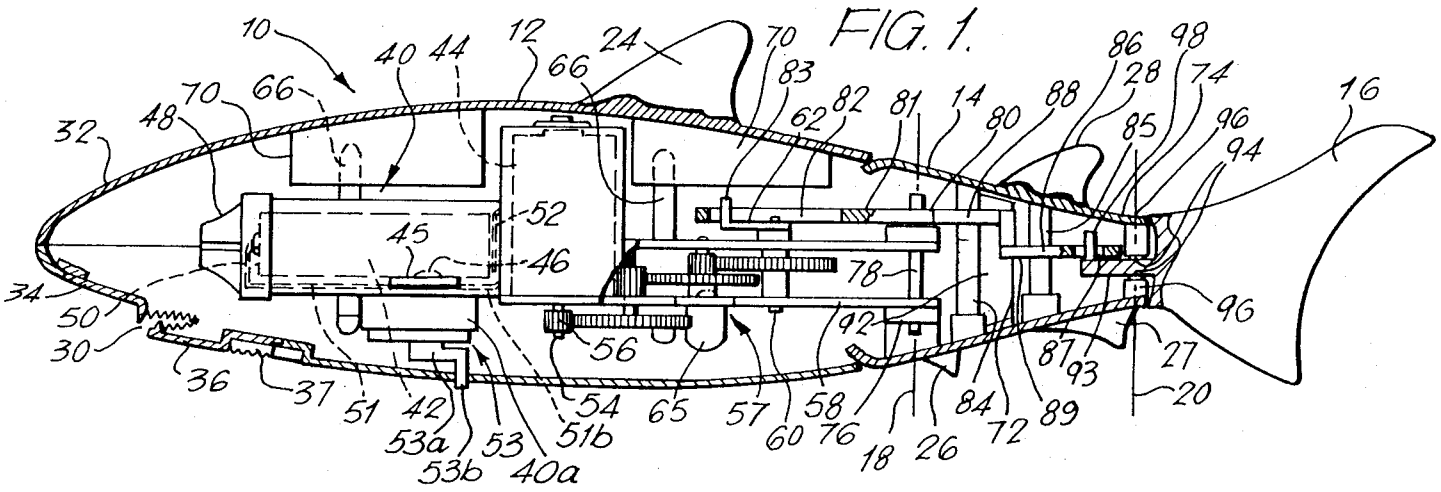
FIG. 1 is a side elevational section of the toy shark.

The toy shark 10 shown in the drawings includes a main body 12, an intermediate tail 14 and an outer tail 16. As will be described, the middle tail portion is pivotally joined to the main body about an upright axis 18. Equally the outer tail is pivoted to the middle tail portion about an upright axis 20.

The toy shark 10 is a reasonably authentic simulation of a shark and includes side fins 22 on the main body portion 12 and an upper dorsal fin 24. Equally the middle tail portion includes appropriate side and dorsal fins 26, 27 and 28. The main body also includes a simulated mouth 30.

The main body is formed from a hollow casing composed of an upper portion 32 and a lower portion 34 both moulded from synthetic plastics material. In the lower portion 34 is provided a removable cover 36 in the region of the mouth 30 to enable the user to obtain access to the interior to insert a battery 42 as will be described. The cover 36 is removably held in place by a slidable latch 37.

A sealed unit 40 is positioned in the main body. This contains the electric storage battery 42 which is arranged to drive an electric motor 44. This casing has side flanges 45 by means of which it is joined by screws 46 to integral upstanding pillars 47 formed in the lower portion 34. The sealed unit has a rotatable screw-on cap 48 and that cap can be unscrewed to obtain access to the battery 42 for replacement of the battery. That access can be obtained upon removal of the cover 36. To maintain a water-tight seal a resilient washer 49 is provided inside the cap.

Figure 2:
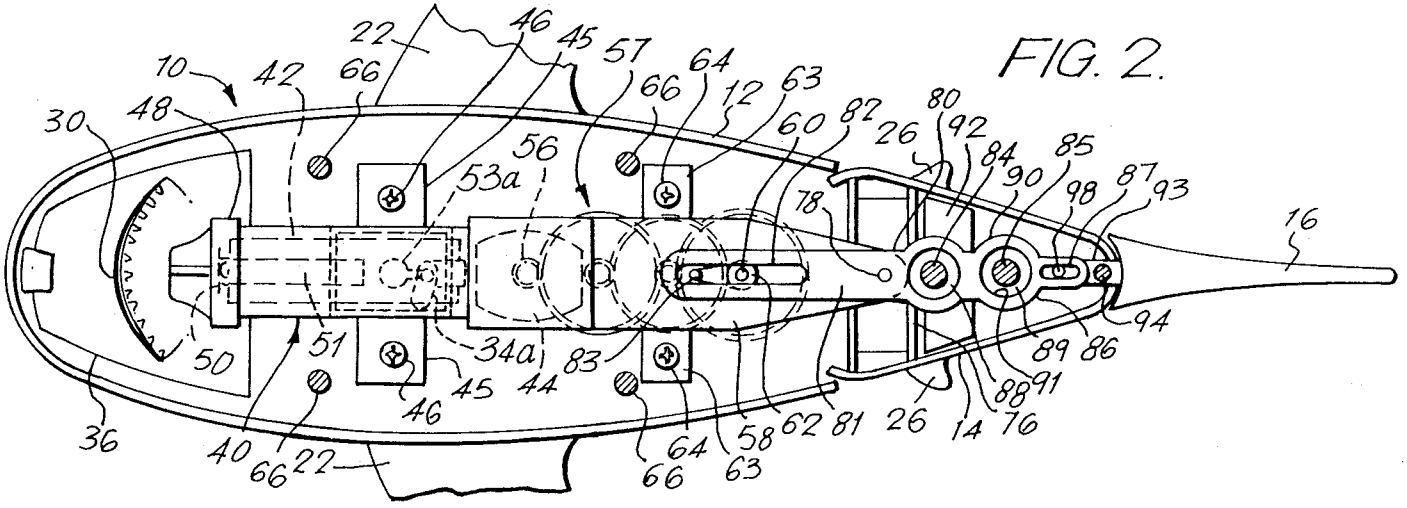
FIG. 2 is a plan sectional view of the toy shark.

As best shown in FIGS. 1 and 2, the cap contains an electrical contact 50 which bears against one terminal of the battery 42. Meanwhile inside the unit 40 a conducting metal strip 51 is fixed by means of a rivet 51*a*. When the cap is closed tightly, the contact 50 also bears against and makes contact with the strip 51.

A second contact 52 bears against the other terminal of the battery 42. This is joined to one input to the motor 44 whilst the other input to the motor 44 is joined to a separate metal strip 51*b* fixed by a rivet 51*c* to the interior of the sealed unit 40.

The two rivets 51*a* and 51*c* form the poles of a switch mechanism 53 for actuating the toy shark. This mechanism comprises a crank 53*a* pivotably mounted in an extension 40*a* of the sealed unit. The crank 53*a* has at its outer end a downwardly depending finger 53*b* which extends out through a slot 34*a* in the lower portion 34. The user can therefore manually move the finger 53*b* from one end to the other of the slot.

The crank 53*a* has at its inner end a metal strip 53*c* which, in an actuating position, spans and contacts both of the rivets 51*a* and 51*c*. However, when the crank is moved so that its finger 53*b* is at the other limit position of the slot 34*a*, the strip 53*c* does not contact the rivets 51*a* and 51*c*. The strip 53*c* therefore acts as an electrical switch and, when it contacts both rivets, it completes the electrical circuit from the battery 42 to the motor 44 so energizing it.

To prevent water entering the sealed unit 40, a resilient gasget 53*d* is provided around the shaft of the crank 53*a*. To give rotational support to the shaft of the crank 53*a*, this extends both through the gasget 53*d* and a circular opening an intermediate plate 40*b* within the extension 40*a*.

The output shaft 54 of the motor 44 extends out through a resilient gasget 55 which acts as a seal to prevent ingress of water to the sealed unit. This output shaft drives a pinion 56 which forms part of the gearbox 57 housed within a support frame 58. This gearbox acts in a reducing sense and so a relatively slower but more powerful final output is provided to a shaft 60 on the top of the frame 58. This shaft 60 carries a crank 62 and, when the motor is driven, this crank rotates about the shaft 60. The frame 58 has a pair of side flanges 63 and these are held by screws 64 to integral upright pillars 65 on the lower body portion 34 to hold it in place.

The upper portion 32 is joined to the lower portion 34 of the casing by providing the upper portion 32 with a number of integral downwardly extending pillars 66 which are engaged by screws (not shown) extending through the lower casing into those pillars.

It will be appreciated that the sealed unit 40 keeps the battery and motor dry but that water can freely enter into the interior of the main body. Therefore, to ensure that the toy shark floats, buoyancy in the form of pieces of polystyrene foam 70 or the like are provided in the upper casing.

The intermediate tail 14 comprises a lower hollow shell 72 and an upper hollow shell 74, both moulded in synthetic plastics material. The lower shell 72 has at its front end an upright frame 76 and this frame is pivotably attached to the rear of the frame 58 containing the gearbox 56 by means of an upright metal pivot pin 78. The intermediate tail can therefore oscillate from side to side about that pin.

Also freely mounted about that pin is an elongated driving member 80. This has an arm 81 extending forwardly of the pin and formed lengthwise in that arm is a slot 82. The slot is engaged by an upstanding pin 83 on the crank 62 and so, as the crank is rotated by the motor 44, the member 80 and its arm 81 oscillate from side to side about the pivot pin 78.

Integrally formed with the upper shell 74 are a pair of upright pillars 84 and 85 which are engaged at their lower ends by screws (not shown) extending through the lower shell 72 to hold the upper and lower shells of the middle tail together.

The driving member 80 also has an integrally formed rearwardly extending arm 86 which at its rear end is provided with a short slot 87. Intermediate between that slot 87 and the pivot pin 78 are provided two enlarged openings 88 and 89 through which the pillars 84 and 85 respectively extend.

The driving member 80 is able to pivot with a certain degree of backlash within the intermediate tail 14. Thus, as best shown in FIG. 2, the member 80 can move freely from side to side until the outer edge 90 of the enlarged opening 89 engages the inside wall of the upper shell 74 and/or the pillar 85 engages the inner edge 91 of the enlarged opening 89. Therefore, as the member 80 is moved to and fro by means of the crank 62, the member 80 can if appropriate take up any backlash between itself and the middle tail 14 until the edge 90 engages the upper shell 74 and/or the edge 91 engages the pillar 85. Thereafter further movement of the member 80 by the crank in the same sense will force the middle tail 14 to pivot about the pivot pin 78.

To provide a degree of buoyancy for the middle tail 14, a piece of polystyrene foam 92 is provided.

The outer tail 16 has been moulded in one piece from synthetic plastics material and includes a forwardly projecting arm 93. This arm has integrally formed with it a pair of aligned pivot pins 94, one projecting upwardly and one projecting downwardly. These pivot pins engage in respective bushes 96 integrally formed in the upper and lower shells 72 and 74 of the middle tail. The outer tail 16 is therefore able to pivot about those pins relative the middle tail 14.

Additionally, the arm 93 has a further upstanding integral pivot pin 98 further forward than the pins 94 and this pin 98 engages in the slot 87 at the end of the member 80.

All the time that the middle tail 14 moves to an exactly corresponding degree of angular movement with the member 80, the outer tail 16 is held in stationary relative the middle tail. However, during such time as the member 80 is moving relative the middle tail to take up any backlash, then that relative movement will, by the engagement of the pin 98 with the slot 87, cause the outer tail 16 to pivot about the pins 94 relative the middle tail 14. It is this movement during the taking up of the backlash which causes the outer tail 16 to be mechanically driven and not just be freely pivotable.

FIGS. 3 to 6 show progressive steps in the movements of the middle and outer tail relative the body.

Figure 3:
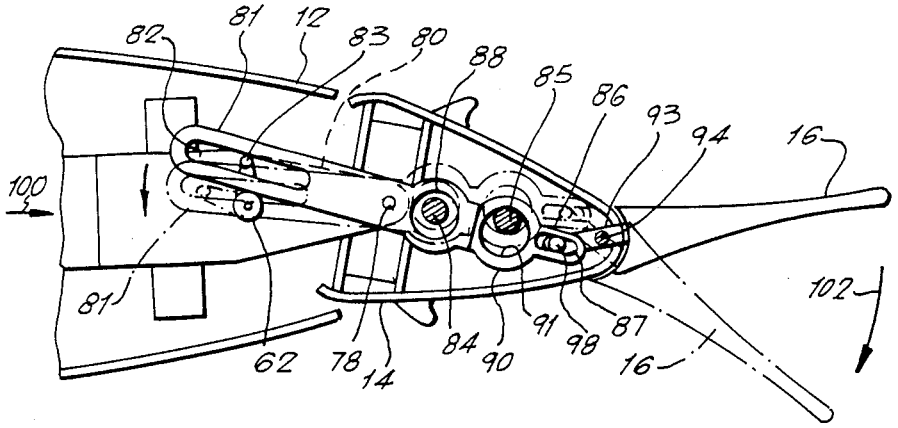
FIGS. 3 to 6 are diagrams illustrating the movement of the tail of the toy shark to drive it through the water.

Starting for example with FIG. 3, the middle tail 14 is initially in its limit position shown in full lines where it has been pivoted towards the right as seen from the front of the shark and hereafter directions "right" and "left" are those as seen from the front of the toy shark in the direction of the arrow 100 shown in FIG. 3.

As the crank 62 rotates as shown in FIG. 3, initially the member 80 does not drive the middle tail 14 but the backlash between the member 80 and tail 14 is taken up. This causes the outer tail 16 to pivot from what was a left-most orientation relative the middle tail to a right-most orientation as shown by the arrow 102. At the completion of the movement of the crank 62 to the position shown in broken lines in FIG. 3, the outer tail has been moved to its right-most limit position shown in broken lines and the edge 90 or 91 has just engaged the upper shell 74 or the pillar 85 of the middle tail and taken up the backlash.

Figure 4:
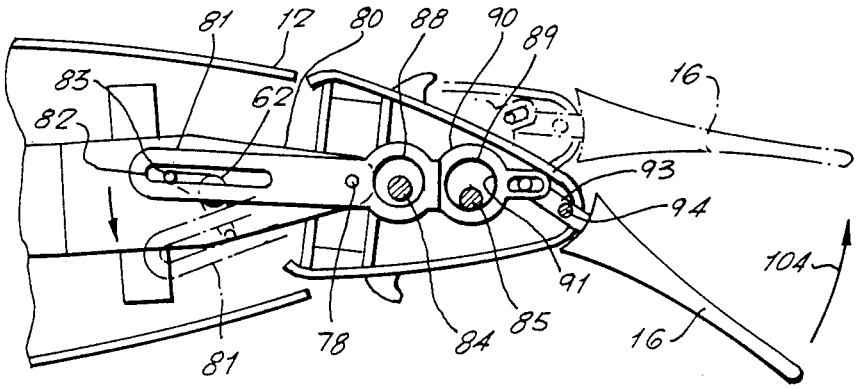

As the crank continues to rotate, further movement then occurs as shown in FIG. 4. Initially the middle tail 14 and outer tail 16 are in the position shown in full lines. The member 80 now moves the middle tail from the right to the left in the direction of the arrow 104 to the position shown in broken lines. In so doing, the outer tail 16 stays in its orientation to the far right relative the middle tail 14 and does not move relative the middle tail. This is the driving or sculling stroke which propels the shark through the water. At the end of the motion shown in FIG. 4, the middle tail has now reached its left-most position.

Figure 5:
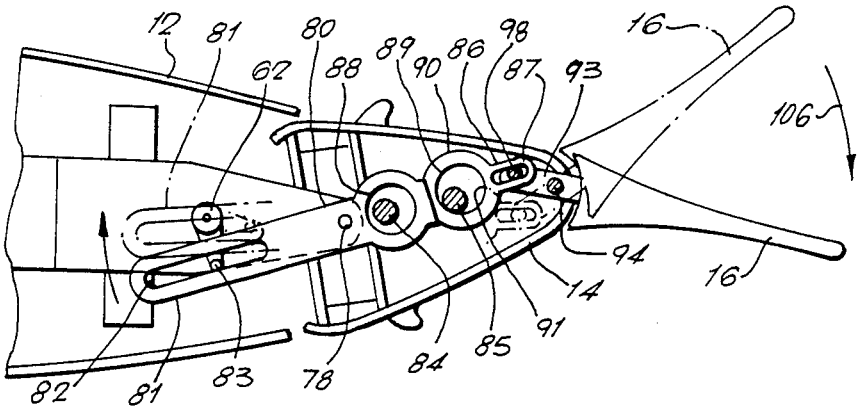

Further movement now occurs as shown in FIG. 5. As the crank 62 continues to rotate, the member 80 will take up the backlash in the other sense from FIG. 3 and so, as shown in FIG. 5, no movement of the middle tail 14 occurs. Instead, the outer tail 16 is now swung from the right to its left-most position relative the middle tail in the direction of the arrow 106 to the broken line position.

Figure 6:
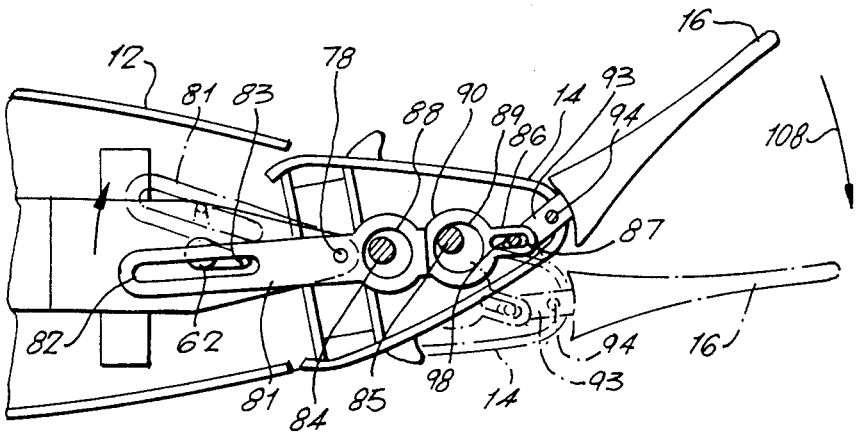
Figure 7:
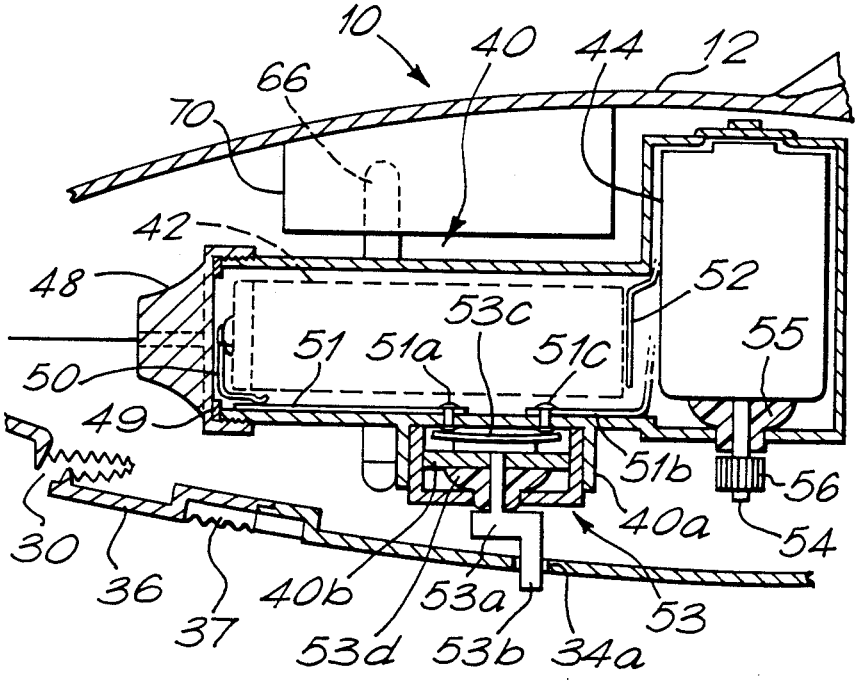
FIG. 7 is an enlarged detail section of part of FIG 1.

Thereafter further movement of the crank is shown in FIG. 6. The backlash had been taken up as shown in FIG. 5 and so further movement of the member 80 now moves the middle tail 14 from the left to the right in the direction of the arrow 108 to the broken lines position. Again, the outer tail 16 does not move relative the middle tail 14 but the movement of the middle tail causes the outer tail to provide the sculling and driving force again advancing the toy shark through the water.

At the end of the motion in FIG. 6, the broken lines position is reached and that is the situation initially described and shown in full lines in FIG. 3. The cycle therefore repeats to give a side-to-side oscillating movement of the middle and outer tails relative the body 12 as long as the motor continues to be energised. In this way the toy shark is propelled through the water with an action which is a very close simulation of a real swimming action of a shark and in addition this provides powerful and effective forward driving action which is achieved in a relatively simple manner.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A self-propelled aquatic toy comprising:

a body, a middle tail pivotably mounted relative said body so as to be capable of rotating clockwise to a first limit position and counterclockwise to a second limit position about a first upright axis, an outer tail pivotably mounted relative said middle tail so as to be capable of rotating clockwise and counterclockwise about a second upright axis, drive means in said body to rotate said middle tail portion from side to side about said first upright axis when the toy is being driven through the water, a rotatable crank driven by said drive means, and a pivoted lever mounted about the first upright axis and engaged by said crank and oscillated about its pivot point upon rotation of said crank, said pivoted lever being connected to said middle tail portion to rotate said middle tail portion about said first upright axis upon actuation of said drive means, said pivoted lever additionally linking said drive means to said outer tail portion, a degree of backlash being provided in the driving of said middle tail by said pivoted lever, whereby operation of said drive means at the first limit position of said middle tail initially takes up said backlash to drive said outer tail to rotate clockwise about said second axis and thereafter said middle tail is then rotated counterclockwise about said first axis to the second limit position at which said middle tail initially takes up said backlash to drive said outer tail to rotate counterclockwise about said second axis.

2. A toy according to claim 1 in which said drive means comprise an electric motor and, a reduction gear box driven by said motor, and said crank means being driven by said gear box, said crank means rotating said middle tail back and forth between said limit positions.

3. A toy according to claim 1 in which said outer tail is pivotally connected to said middle tail and has a lever arm extending to within said middle tail and linked to said pivoted lever on the opposite side of the point of pivoting of the pivoted lever from said crank.

4. A toy according to claim 1 in which said pivoted lever is loosely positioned in said middle tail whereby said middle tail can pivot to a limited extent relative said pivoted lever, pivoting to that limited extent causing said outer tail to pivot relative said middle tail.

5. A toy according to claim 4 in which said outer tail is pivotally connected to said middle tail and has a lever arm extending to within said middle tail and linked to said pivoted lever on the opposite side of the point of pivoting of the pivoted lever from said crank.

6. A toy according to claim 2 further comprising a switch mechanism for the control of said electric motor, said switch mechanism including a member projecting out through said body of said toy, said member being movable between one limit where said switch mechanism completes a circuit to activate said motor and another limit where said switch mechanism deactivates said motor.

7. A toy according to claim 1 which is in the shape of a shark.

* * * * *